United States Patent [19]

Accati et al.

[11] Patent Number: 4,999,166

[45] **Date of Patent: * Mar. 12, 1991**

[54] FURNACE FOR FIRING WIRE-LIKE PRODUCTS

[75] Inventors: Silla F. Accati, Torino; Hans J. Reiser, Br-Newbchland, both of Italy

[73] Assignee: Societa' Industriale Costruzioni Microelettriche, Turin, Italy

[ * ] Notice: The portion of the term of this patent subsequent to Aug. 15, 2006 has been disclaimed.

[21] Appl. No.: 162,155

[22] Filed: Feb. 29, 1988

[51] Int. Cl.[5] ..... F26B 13/00

[52] U.S. Cl. ..... 422/131; 34/23; 126/108; 422/129; 422/199; 432/8; 432/59; 432/72

[58] Field of Search ..... 422/129, 131, 199; 432/8, 59, 72, 125, 94; 34/23, 155; 126/108

[56] References Cited

U.S. PATENT DOCUMENTS 3,501,620 12/1968 Sauer ..... 219/400
4,303,387 12/1981 Burke et al. ..... 432/59 X
4,398,472 8/1983 Burke et al. ..... 432/72 X
4,448,578 5/1984 Brunet et al. ..... 432/59 X
4,856,986 8/1989 Macocco ..... 432/72

*Primary Examiner*—Robert J. Warden
*Assistant Examiner*—Amalia L. Santiago
*Attorney, Agent, or Firm*—Gifford, Groh, Sprinkle, Patmore and Anderson

[57] ABSTRACT

A furnace for firing an enamelled wire comprising a principal chamber, an auxiliary unit for the aspiration of a first stream of air and solvent vapours from this principal chamber and combustion of the vapors themselves, and a duct assembly operable to introduce gaseous streams into the principal chamber for controlling the temperature within the principal chamber; the auxiliary unit comprises a heater constituted by a plurality of electrical resistances operable to heat this first stream at least up to a temperature sufficient to cause initiation of the combustion of the said vapors, and by a support structure for these resistances, housable in a duct of the auxiliary unit; the support structure and the walls of the duct are made in steel alloy which is highly resistant to high temperatures. (FIG. 1 and 2).

10 Claims, 2 Drawing Sheets

FURNACE FOR FIRING WIRE-LIKE PRODUCTS

BACKGROUND OF THE INVENTION

The present invention relates to a furnace for firing wire-like products, and in particular copper wires enamelled with a cladding of insulating plastics resin.

As is known, furnaces currently utilised for firing the cladding of copper wires are of the continuous tunnel type and comprise at least one chamber of elongate form in which the wire is advanced longitudinally. In a first portion of this chamber evaporation of the solvents which impregnate the resins of the cladding take place; in a second portion of the chamber, maintained at a higher temperature than that of the first portion, polymerisation and cross linking of the resin itself take place.

Since the solvent vapours are pollutants the furnaces generally include an auxiliary unit which draws in a mixture of air and the said vapours at the end of the first portion of the chamber and directs it to a heating unit in which this mixture reaches the combustion temperature of the said vapours before being delivered to the chimney or at least part reintroduced, possibly mixed with air at ambient temperature drawn from the outside, into the principal chamber for controlling the temperature thereof.

In particular this heating unit generally includes an electrical resistance heater and a catalytic plate heater disposed in series with one another. The resistance heater heats the mixture of air and vapours up to a temperature sufficient to trigger the combustion of the vapours themselves, after which the catalytic plate encourages the complete oxidisation of these vapours into harmless combustion products (carbon dioxide and steam).

The fundamental disadvantage of heating units of this type is the limited durability of the catalytic plate, which must be periodically replaced; this involves stopping the furnace for several days. Moreover, the mixture cannot be heated by the electrical resistance to a temperature greater than a certain threshold, normally at around 600° C., in certain cases 700°-750° C., above which the catalytic plate is damaged; this temperature limitation does not allow the use of certain enamels which could on the other hand be conveniently utilised, in that complete combustion of the solvent vapours would not be obtained. Finally, the catalytic plate does not allow the combustion temperature to be precisely regulated in dependence on the various types of enamel used.

SUMMARY OF THE INVENTION

The object of the present invention is the provision of a furnace for firing copper wires clad in plastics resin, which will be free from the above-mentioned disadvantages.

The said object is achieved by the present invention in that it relates to a furnace for firing wire-like products, in particulare copper wires clad with plastics resin, of the type comprising: a principal chamber of elongate form within which the said products translate axially in a longitudinal direction between an inlet opening and an outlet opening, the said principal chamber defining a first portion in which the solvents evaporate from the said plastics resin and a second portion in which polymerisation and cross linking of the said plastics resin take place; an auxiliary unit including an aspiration opening communicating with the said principal chamber, means for aspirating a first stream of air and solvent vapours from the said principal chamber and means for heating the said first stream to cause combustion of the said vapours; means for aspirating a first volume of air from an external environment; means for introduction to the said principal chamber of the mixture of at least a portion of the said first volume of air with at least a first portion of a second stream leaving the said auxiliary unit; and means for introducing at least a second portion of the said second stream to a chimney; characterised by the fact that the said heating means are constituted by a plurality of electrical resistors operable to heat the said first stream at least up to a threshold temperature such as to initiate combustion of the said vapours, substantially complete combustion of the said vapours taking place without the action of other means.

BRIEF DESCRIPTION OF THE DRAWINGS

For a better understanding of the present invention a preferred embodiment is described purely by way of non-limitative example and with reference to the attached drawings, in which.

DETAILED DESCRIPTION OF THE INVENTION

Figure 1:
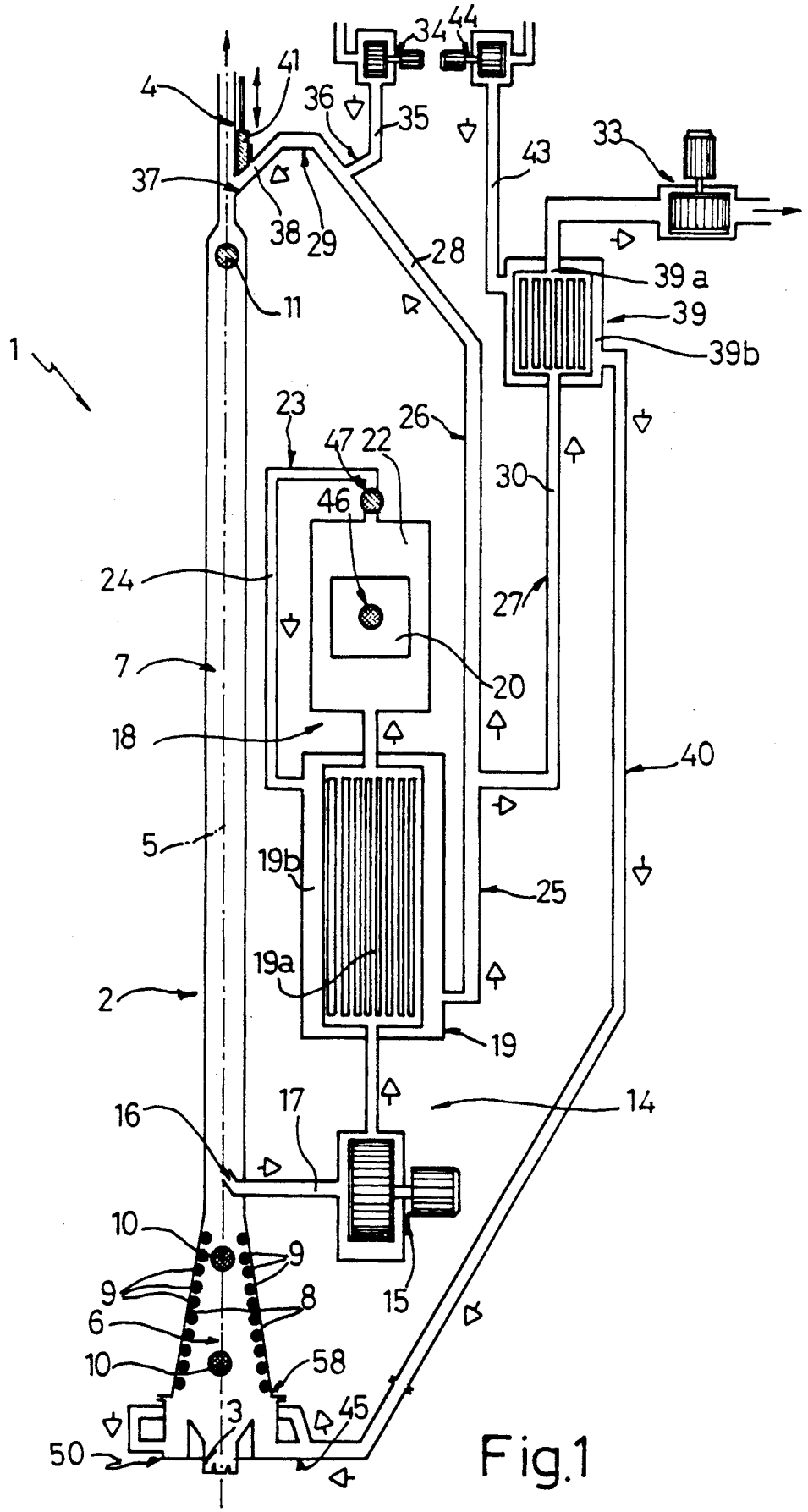
FIG. 1 schematically illustrates a furnace formed according to the principles of the present invention.

With reference to FIG. 1, a furnace for firing the insulating plastics resin cladding of electrically conductive copper wires is generally indicated with the reference numeral 1, which furnace comprises, in a known way, a principal chamber 2 provided with an inlet opening 3 and an outlet opening 4, in which the wire 5 advances longitudinally in a continuous manner. This chamber 2 has an elongate form and comprises a first portion 6 the cross section of which increases towards the inlet opening 3, and a second portion 7 of substantially constant cross section. Along the side walls 8 of the first portion 6 are disposed heating elements 9, conveniently constituted by electrical resistors. A a first temperature sensor 10 housed in the said first portion 6 and a second temperature sensor 11 housed in the second portion 7 close to the outlet opening 4 detect the temperature in these portions.

The furnace 1 further includes an auxiliary unit 14 disposed alongside the principal chamber 2; this auxiliary unit 14 includes a first fan 15 facing an aspiration opening 16 communicating with the principal chamber 2 close to the junction between the two portions 6, 7 of the chamber 2 itself and operable to draw in a first stream 17 of a mixture of air and solvent vapours produced in the first portion 6, a first heat exchanger 19 and an electrical resistance heater 20 housed in a first duct 22. A first primary circuit **19*a* of the heat exchanger 19 and the duct 22 are disposed in series downstream from the fan 15. A second duct 23 carries a second stream 24 exiting from the heater 20 to a first secondary circuit 19*b* of the heat exchanger 19 in counter current with respect to the primary circuit 19*a* in such a way as to preheat the first stream 17 entering the heater 20 itself. Third and fourth temperature sensors 46, 47 respectively detect the temperature of the first stream 17 within the heater 20 and the second stream 24 exiting therefrom. The sensor 46** controls, in a known way, switch means of conventional type, not illustrated, as described hereinbelow.

Fron an outlet duct 25 of the auxiliary unit 14 branch third and fourth ducts 26, 27 operable to convey respectively a second stream first portion 28 of the second stream 24 towards a recirculation duct 29 leading to the interior of the second portion 7 of the chamber 2, and a second stream second portion 30 towards a second fan 33 which delivers it to the chimney. A third fan 34 draws a first airflow 35 from the outside and delivers it into a fifth duct 36 which leads, together with the third duct 26, into the recirculation duct 29 which opens into the second portion 7 of the principal chamber 2 through a first aperture 37 closable by a gate valve 41; the arrangement of the recirculation duct 29 is such as to introduce a third stream 38 resulting from the mixture second stream first portion 28 of the second stream 24 with first airflow 35 in a direction substantially opposite the direction of advancement of the wire 5. The furnace 1 includes a second heat exchanger 39 a second primary circuit **39*a* of which is disposed in series with the fourth duct 27 and a second secondary circuit 39*b* of which flows in counter current with respect to the first and is disposed in series with a sixth duct 40 which conveys a second airflow 43 from a fourth fan 44, which draws it from the external environment, to an opening 45 for introduction into the first portion 6 of the principal chamber 2**.

Figure 2:
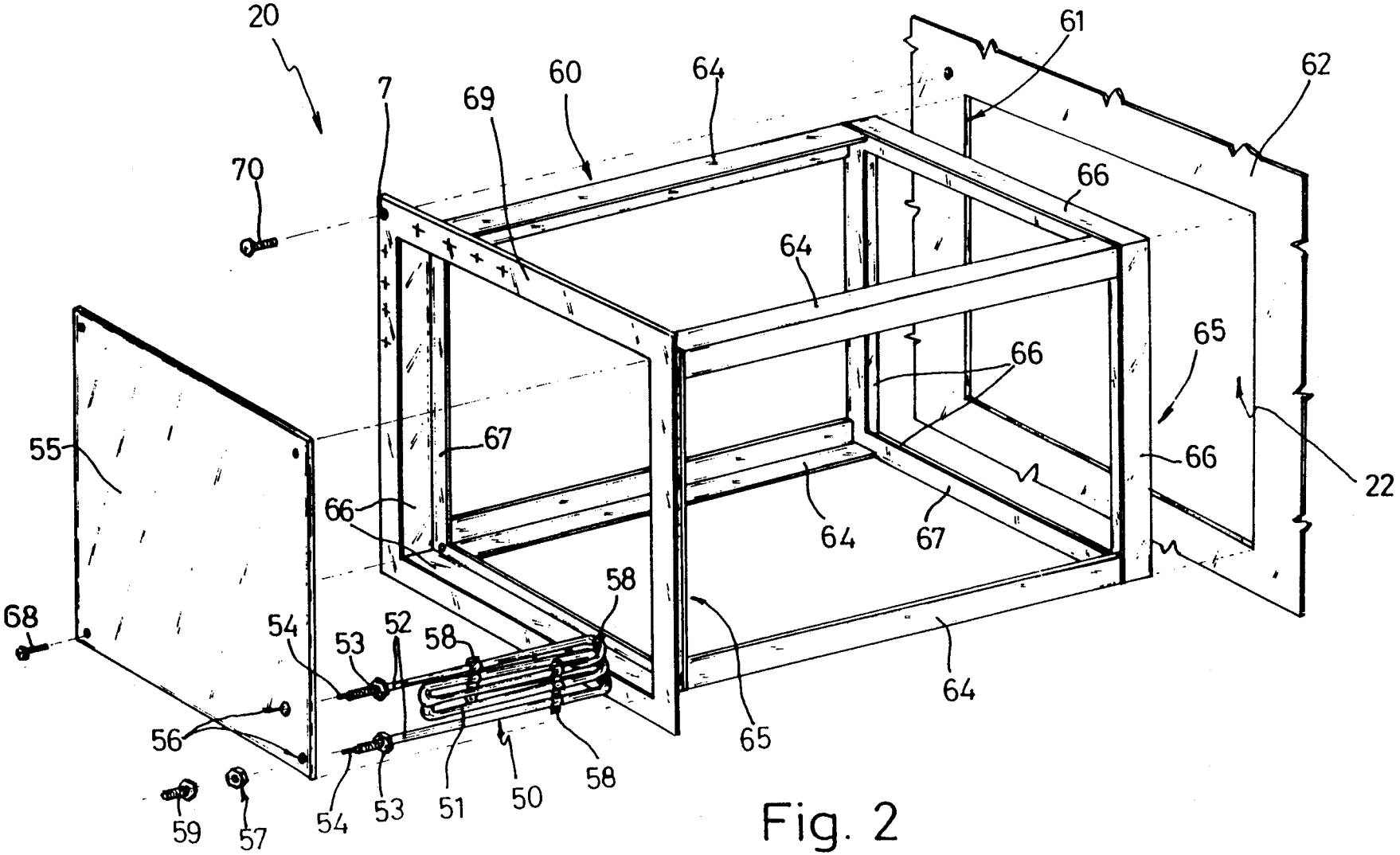
FIG. 2 is a perspective view of a heater of the furnace of FIG. 1, exploded to show its elements.

Referring to FIG. 2, and further according to the present invention the heater 20 includes a plurality of electrical resistors 50 of armoured type connected in series with the said switch means. The resistors 50 each include an outer tubular casing 51 having three elongate loops with terminal sections 52 parallel to one another and provided with externally threaded end sockets 53; within this casing is disposed a coil of resistive wire, not illustrated, welded to the ends of respective threaded pins 54 which project from the sockets 53; the casing is filled with electrically fused magnesium oxide and is conveniently made of high temperature alloyed steel, for example of the type known as Incoloy. The resistors 50 are fixed to a plate 55 provided with a plurality of holes 56 into which the terminal sockets 52 are introduced and clamped by means of respective nuts 57. The various loops of the resistors 50 are fixed together by bands 58 made in two halves provided with facing semicylindrical hollows and joined together in the spaces between one turn and the next by means of electric spot welding. The bands 58 have the purpose of giving the resistors 50 a mechanical rigidity at high temperatures sufficient to prevent deformations of the resistors 50 under their own weight. Further terminals 59 form connections, in a known way, between the pins 54 and respective electrical terminals of an electrical supply circuit for the resistors 50, not illustrated. The heater 20 further includes a resistor support unit 60 of rectangular form which can be introduced, in use into a second aperture 61 of a front wall 62 of the first duct 22, partially represented in FIG. 2. The resistor support unit 60 is constituted by four L-section strips 64 welded at their ends to two rectangular frames 65 each of which is constituted by four sheet metal strips 66 disposed substantially along the planes defined by the four L-section strips 64, and by a flat stop frame element 67. In particular the elements 67 are welded on one face, along their perimeter, to the said strips 66, and on their opposite face, at their corners, to the L-section strips 64. One of the frames 65 houses the plate 55 which is fitted inside the strips 66 and fixed by means of four first screws 68, close to its corners, to the stop element 67; finally, a perimetrical rectangular flange 69 is welded to this frame 65, which forms a stop for the support unit 60 against the front wall 62 of the first duct 22 around the periphery of the second aperture 61, on which the flange 69 itself is fixed, in use, by means of a plurality of second screws 70. The various parts of the resistor support unit 60, the plate 55 and the walls of the duct 22, at least in the section in which the resistor support unit 60 is inserted, are conveniently made in stainless steel alloyed with noble metals (for example tantalum) or other material resistant to high temperatures, for example Incoloy.

The operation of the furnace 1 is as follows. The wire 5 enters into the principal chamber 2 through the inlet opening 3 and passes through the first portion 6 where the solvents evaporate from the resin which constitutes the cladding; it then passes into the second portion 7, maintained at a higher temperature than that of the portion 6, where polymerisation and cross linking of the resin take place. The first stream 17 drawn by the first fan 15 is substantially constituted by a mixture of air and solvent vapours. This mixture is first preheated by the heat exchanger 19 and it then passes into the heater 20 in which it flows over the resistors 50 which heat it to a temperature, for example 750° C., sufficient to initiate combustion of the said vapours, that is to say their oxidation into harmless combustion products (carbon dioxide and steam); when this temperature is reached the third temperature sensor 46 causes commutation of the switch means which disconnect the electricity supply to the resistors 50. Since the oxidation reaction liberates heat energy the temperature continues to rise (for example up to 900°-950° C.) until the combustion is completed, which therefore takes place without further energy consumption. The combustion products constitute, together with possible excess air, the said second stream 24 which yields part of its heat energy to the first stream 17 in the heat exchanger 19.

This second stream 24 is then divided. The second stream first portion 28, mixed with the first airflow 35 drawn in by the third fan 34, is introduced in counter current into the second chamber 7 for the dual purpose of controlling its temperature, in dependence on the values detected by the sensor 11, and of preventing a heavy flow of hot fluid through the outlet opening 4. These effects are controlled both by suitably throttling the first aperture 37 with the gate valve 41 and by varying the speed of the third fan 34 and therefore the rate of flow of the first airflow 35. The second portion 30 of the second stream 24 yields the greatest possible part of its heat energy to the second airflow 43 and is then delivered to the chimney at a relatively low temperature. The second airflow 43, which in this way can reach temperatures of the order of 380°-600° C., is then introduced into the first portion 6 of the principal chamber 2 close to the inlet mouth 3 and in a direction substantially parallel to the side walls 8 of the portion 6 itself, with the dual purpose of re-utilising the heat energy of the second stream second portion 30 of the second stream 24 which otherwise would have been lost, and of reducing the intake of cold air through the inlet opening 3.

These effects are controlled by varying the speed of the fans 44 and 33, that is to say by varying the rate of flow of the second portion 30 of the second stream 24 and the cold air 43. Similarly, depending on the temperature values detected by the sensors 10, 46 and 47, the heat introduced by the heating elements 9 and the heater 20, as well as the rate of flow of the first stream 17 are controllled.

From a study of the characteristics of the furnace 1 formed according to the present invention the advantages which it enable to be obtained are evident.

The combustion of the solvent vapours takes place entirely within the electrical resistance heater 20 without the use of catalytic plates, with the consequent elimination of dead times for the replacement of these plates. The temperature in the heater 20 can be suitably regulated and adapted to the optimum combustion conditions of the vapours, and in particular, given the choice of materials with which the heater 20 and the duct 22 are made, can be raised without damage up to 900°–950° C., which allows operation with any type of enamel.

Finally, combustion is achieved with a reduced energy consumption in that the introduction of heat by the resistors 50 is limited to a triggering phase after which the combustion is self-sustaining until complete oxidisation of the solvent vapours has occured.

Finally, it is clear that the furnace 1 described can have modifications and variations introduced thereto without by this departing from the protective scope of the present invention. In particular, the heat exchanger 19, the heat exchanger 39, the heating elements 9 can all be omitted. In the case in which the heat exchanger 39 is not present a portion of the second stream 24 can be introduced into the first poriton 6 of the principal chamber 2, possibly mixed with air at ambient temperature. The resistors 50 can be permanently connected and the rate at which they supply heat can be controlled by varying their supply voltage.

Moreover, the points of withdrawal and introduction of fluid into the principal chamber 2 can be varied. Finally, the furnace 1 can include two or more adjacent principal chambers 2 operating over different temperature ranges, and the wire 5 can be guided by suitable guide means to pass several times through one and/or the other principal chamber 2.

We claim:

1. A furnace for firing wire-like products, in particular copper wires clad with plastics resin, of the type comprising: a principal chamber of elongate form within which said products translate axially in a longitudinal direction between an inlet opening and an outlet opening of said principal chamber, said principal chamber further defining a first portion in which evaporation of the solvents from said plastics resins takes place and a second portion in which polymerization and cross linking of said plastics resins takes place; an auxiliary unit including an aspiration opening communicating with said principal chamber, means for drawing a first stream of air and solvent vapors from said principal chamber and an electrical resistance heater for heating said first stream to cause combustion of said vapors to form a second stream exiting from said auxilliary unit; a first fan for drawing a first airflow from an external environment a first portion of said second stream; a first aperture for introducing to said principal chamber a mixture of at least a portion of said first airflow stream with said first portion of said second stream from said auxiliary unit; and a second fan for introducing at least a of said air and solvent second portion of said second stream to a chimney; wherein said resistance heater is constituted of a plurality of electrical resistors for heating said first stream of said air and solvent at least to a threshold temperature at which combustion of said vapors is initiated, said electrical resistors being mounted on a support structure housable in a first duct of said auxiliary unit, said support structure and at least a portion of said first duct adjacent to said support structure being made of a metal alloy resistant to high temperatures.

2. A furnace according to claim 1, further comprising a third temperature sensor for controlling the rate of generation of heat by said resistors.

3. A furnace according to claim 1, wherein said third temperature sensor operable to detects the temperature of at least said first stream in the vicinity of said resistors and interrrupts electrical supply to said resistors when said temperature reaches a threshold value sufficient to initiate combustion of said vapors and to ensure a substantially complete development thereof.

4. A furnace according to claim 1, characterized by the fact that said support structure includes a resistor support unit of substantially rectangular form introduced into said first duct through a second aperture in a front wall of said first duct.

5. A furnace according to claim 4, characterized by the fact that said resistor support unit comprises a pair of rectangular frames connected together at respective corners by four L-section strips, a first of said rectangular frames having a perimetrical rectangular flange fixed to said front wall around a periphery of said second aperture.

6. A furnace according to claim 4 characterized by the fact that said support structure includes a plate on which said resistors are fixed so as to project therefrom; said plate being fixed to a first rectangular frame whereby said resistors project into the interior of said first duct.

7. A furnace according to claim 1, wherein said resistors comprise a resistive wire housed in an external tubular casing made of metal alloy resistant to high temperatures, said resistors further defining a plurality of loops and connected at its terminal sections to said plate; said casing being filled with an insulating material.

8. A furnace according to claim 7, characterized by the fact that said loops of said resistors are secured together by at least one reinforcing element in the form of bands.

9. A furnace according to claim 1, characterized by the fact that said auxiliary unit comprises a second heat exchanger for exchanging heat between said first stream entering said resistance heater and said second stream leaving said resistance heater.

10. A furnace according to claim 1, characterized by the fact that it comprises: a third fan for aspirating a second airflow stream from an external environment, a second heat exchanger for exchanging heat between a second portion of said second stream and said second airflow stream, and a further duct and an opening for introducing said second airflow stream into the interior of said principal chamber.

* * * * *